US007564433B2

(12) United States Patent
Hector et al.

(10) Patent No.: US 7,564,433 B2
(45) Date of Patent: Jul. 21, 2009

(54) ACTIVE MATRIX DISPLAY DEVICES

(75) Inventors: Jason R. Hector, Redhill (GB); Mark J. Childs, Wootton Bassett (GB); David A. Fish, Haywards Heath (GB); Mark T. Johnson, Veldhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 362 days.

(21) Appl. No.: 10/542,903

(22) PCT Filed: Jan. 20, 2004

(86) PCT No.: PCT/IB2004/000156

§ 371 (c)(1),
(2), (4) Date: Jul. 20, 2005

(87) PCT Pub. No.: WO2004/066249

PCT Pub. Date: Aug. 5, 2004

(65) Prior Publication Data

US 2006/0077134 A1 Apr. 13, 2006

(30) Foreign Application Priority Data

Jan. 24, 2003 (GB) ..... 0301659.9
Apr. 11, 2003 (GB) ..... 0308396.1

(51) Int. Cl.
*G09G 3/32* (2006.01)
*G09G 3/30* (2006.01)

(52) U.S. Cl. ..... 345/82; 345/76

(58) Field of Classification Search ..... 345/76, 345/82, 83, 60–100; 315/169.3
See application file for complete search history.

(56) References Cited

U.S. PATENT DOCUMENTS 7,061,452 B2 * 6/2006 Inoue et al. ..... 345/76
2002/0030647 A1 * 3/2002 Hack et al. ..... 345/82
2002/0038998 A1 * 4/2002 Fujita et al. ..... 313/495
2002/0054003 A1 5/2002 Kodate (Continued)

FOREIGN PATENT DOCUMENTS

EP 0717446 A1 6/1996

(Continued)

OTHER PUBLICATIONS

Joon- Chul Goh, et al: A New Pixel Circuit for Active Matrix Organic Light Emitting Diodes, IEEE, vol. 23, No. 9, Sep. 2002, pages.

(Continued)

*Primary Examiner*—Amare Mengistu
*Assistant Examiner*—Robert R Rainey

(57) ABSTRACT

An active matrix display device uses an amorphous silicon drive transistor for driving a current through an LED display element. First and second capacitors are connected in series between the gate and source of the drive transistor, with a data input to the pixel provided to the junction between the first and second capacitors. The second capacitor is charged to a pixel data voltage, and a drive transistor threshold voltage is stored on the first capacitor. This pixel arrangement enables a threshold voltage to be stored on the first capacitor, and this can be done each time the pixel is addressed, thereby compensating for age-related changes in the threshold voltage.

34 Claims, 10 Drawing Sheets

U.S. PATENT DOCUMENTS

| | | | | |
|---|---|---|---|---|
| 2002/0089496 | A1* | 7/2002 | Numao | 345/204 |
| 2003/0052843 | A1* | 3/2003 | Yamazaki et al. | 345/82 |
| 2003/0098828 | A1* | 5/2003 | Hunter et al. | 345/76 |
| 2005/0104814 | A1* | 5/2005 | Choi et al. | 345/76 |
| 2005/0156829 | A1* | 7/2005 | Choi et al. | 345/76 |

FOREIGN PATENT DOCUMENTS

WO WO9636959 A1 11/1996

OTHER PUBLICATIONS

Yumoto A, et al: Pixel-Driving Methods for Large-Sized Poly-SI AM-OLED Displays, IDW, vol. Conf. 21/8, Oct. 2001, pp. 1395-1398.

Yi He, et al: Four-Thin Film Transistor Pixel Electrode Circuits for Active-Matrix Organic Light-Emitting Displays, vol. 40, No. 3A Part 1, Mar. 2001, pp. 1199-1208.

He Y, et al: Current_Source A-Si :H Thin-Film Transistor Circuit for Active-Matrix Organic Light-Emiting Displays, IEEE Inc, vol. 21, No. 12, Dec. 2000, pp. 590-592.

S. R. Forest, et al: Electrophosphorescent Organic Light Emitting Devices: 52.1 SID, May 2002, pp. 1357-1359.

J. P. J. Markham: Highly Efficient Solution Processible Dendrimer LED's, L-8 SID, May 2002, pp. 1032-1035.

* cited by examiner

ACTIVE MATRIX DISPLAY DEVICES

This invention relates to active matrix display devices, particularly but not exclusively active matrix electroluminescent display devices having thin film switching transistors associated with each pixel.

Matrix display devices employing electroluminescent, light-emitting, display elements are well known. The display elements may comprise organic thin film electroluminescent elements, for example using polymer materials, or else light emitting diodes (LEDs) using traditional III-V semiconductor compounds. Recent developments in organic electroluminescent materials, particularly polymer materials, have demonstrated their ability to be used practically for video display devices. These materials typically comprise one or more layers of a semiconducting conjugated polymer sandwiched between a pair of electrodes, one of which is transparent and the other of which is of a material suitable for injecting holes or electrons into the polymer layer.

The polymer material can be fabricated using a CVD process, or simply by a spin coating technique using a solution of a soluble conjugated polymer. Ink-jet printing may also be used. Organic electroluminescent materials exhibit diode-like I-V properties, so that they are capable of providing both a display function and a switching function, and can therefore be used in passive type displays. Alternatively, these materials may be used for active matrix display devices, with each pixel comprising a display element and a switching device for controlling the current through the display element.

Display devices of this type have current-driven display elements, so that a conventional, analogue drive scheme involves supplying a controllable current to the display element. It is known to provide a current source transistor as part of the pixel configuration, with the gate voltage supplied to the current source transistor determining the current through the display element. A storage capacitor holds the gate voltage after the addressing phase.

FIG. 1 shows a known pixel circuit for an active matrix addressed electroluminescent display device. The display device comprises a panel having a row and column matrix array of regularly-spaced pixels, denoted by the blocks 1 and comprising electroluminescent display elements 2 together with associated switching means, located at the intersections between crossing sets of row (selection) and column (data) address conductors 4 and 6. Only a few pixels are shown in the Figure for simplicity. In practice there may be several hundred rows and columns of pixels. The pixels 1 are addressed via the sets of row and column address conductors by a peripheral drive circuit comprising a row, scanning, driver circuit 8 and a column, data, driver circuit 9 connected to the ends of the respective sets of conductors.

The electroluminescent display element 2 comprises an organic light emitting diode, represented here as a diode element (LED) and comprising a pair of electrodes between which one or more active layers of organic electroluminescent material is sandwiched. The display elements of the array are carried together with the associated active matrix circuitry on one side of an insulating support. Either the cathodes or the anodes of the display elements are formed of transparent conductive material. The support is of transparent material such as glass and the electrodes of the display elements 2 closest to the substrate may consist of a transparent conductive material such as ITO so that light generated by the electroluminescent layer is transmitted through these electrodes and the support so as to be visible to a viewer at the other side of the support. Typically, the thickness of the organic electroluminescent material layer is between 100 nm and 200 nm. Typical examples of suitable organic electroluminescent materials which can be used for the elements 2 are known and described in EP-A-0 717446. Conjugated polymer materials as described in WO96/36959 can also be used.

FIG. 2 shows in simplified schematic form a known pixel and drive circuitry arrangement for providing voltage-programmed operation. Each pixel 1 comprises the EL display element 2 and associated driver circuitry. The driver circuitry has an address transistor 16 which is turned on by a row address pulse on the row conductor 4. When the address transistor 16 is turned on, a voltage on the column conductor 6 can pass to the remainder of the pixel. In particular, the address transistor 16 supplies the column conductor voltage to a current source 20, which comprises a drive transistor 22 and a storage capacitor 24. The column voltage is provided to the gate of the drive transistor 22, and the gate is held at this voltage by the storage capacitor 24 even after the row address pulse has ended. The drive transistor 22 draws a current from the power supply line 26.

To date, the majority of active matrix circuits for LED displays have used low temperature polysilicon (LTPS) TFTs. The threshold voltage of these devices is stable in time, but varies from pixel to pixel in a random manner. This leads to unacceptable static noise in the image. Many circuits have been proposed to overcome this problem. In one example, each time the pixel is addressed the pixel circuit measures the threshold voltage of the current-providing TFT to overcome the pixel-to-pixel variations. Circuits of this type are aimed at LTPS TFTs and use p-type devices. Such circuits cannot be fabricated with hydrogenated amorphous silicon (a-Si:H) devices, which is currently restricted to n-type devices.

The use of a-Si:H has however been considered. The variation in threshold voltage is small in amorphous silicon transistors, at least over short ranges over the substrate, but the threshold voltage is very sensitive to voltage stress. Application of the high voltages above threshold needed for the drive transistor causes large changes in threshold voltage, which changes are dependent on the information content of the displayed image. There will therefore be a large difference in the threshold voltage of an amorphous silicon transistor that is always on compared with one that is not. This differential ageing is a serious problem in LED displays driven with amorphous silicon transistors.

Generally, proposed circuits using a-Si:H TFTs use current addressing rather than voltage addressing. Indeed, it has also been recognised that a current-programmed pixel can reduce or eliminate the effect of transistor variations across the substrate. For example, a current-programmed pixel can use a current mirror to sample the gate-source voltage on a sampling transistor through which the desired pixel drive current is driven. The sampled gate-source voltage is used to address the drive transistor. This partly mitigates the problem of uniformity of devices, as the sampling transistor and drive transistor are adjacent each other over the substrate and can be more accurately matched to each other. Another current sampling circuit uses the same transistor for the sampling and driving, so that no transistor matching is required, although additional transistors and address lines are required.

The currents required to drive conventional LED devices are quite large, and this has meant that the use of amorphous silicon for active matrix organic LED displays has been difficult. Recently, OLEDs and solution-processed OLEDs have shown extremely high efficiencies through the use of phosphorescence. Reference is made to the articles 'Electrophosphorescent Organic Light Emitting Devices', 52.1 SID 02 Digest, May 2002, p 1357 by S. R. Forrest et al, and 'Highly Efficient Solution Processible Dendrimer LEDs', L-8 SID 02

Digest, May 2002, p 1032, by J. P. J. Markham. The required currents for these devices are then within the reach of a-Si TFTs. However, additional problems come into play.

The extremely small currents required for phosphorescent organic LEDs result in column charging times that are too long for a large display. A further problem is the stability (rather than the absolute value) of the threshold voltage of the TFTs. Under constant bias, the threshold voltage of a TFTs increases, therefore simple constant current circuits will cease to operate after a short time.

Difficulties therefore remain in implementing an addressing scheme suitable for use with pixels having amorphous silicon TFTs, even for phosphorescent LED displays.

According to the invention, there is provided an active matrix device comprising an array of display pixels, each pixel comprising:

a current driven light emitting display element;

an amorphous silicon drive transistor for driving a current through the display element;

first and second capacitors connected in series between the gate and source or drain of the drive transistor, a data input to the pixel being provided to the junction between the first and second capacitors thereby to charge the second capacitor to a voltage derived from the pixel data voltage, and a voltage derived from the drive transistor threshold voltage being stored on the first capacitor.

This pixel arrangement enables a threshold voltage to be stored on the first capacitor, and this can be done each time the pixel is addressed, thereby compensating for age-related changes in the threshold voltage. Thus, an amorphous silicon circuit is provided that can measure the threshold voltage of the current-providing TFT once per frame time to compensate for the aging effect.

In particular, the pixel layout of the invention can overcome the threshold voltage increase of amorphous silicon TFT, whilst enabling voltage programming of the pixel in a time that is sufficiently short for large high resolution AMOLED displays.

Each pixel may further comprise an input first transistor connected between an input data line and the junction between the first and second capacitors. This first transistor times the application of a data voltage to the pixel, for storage on the second capacitor.

Each pixel may further comprise a second transistor connected between the gate and drain of the drive transistor. This is used to control the supply of current from the drain (which may be connected to a power supply line) to the first capacitor. Thus, by turning on the second transistor, the first capacitor can be charged to the gate-source voltage. The second transistor may be controlled by a first gate control line which is shared between a row of pixels.

In one example, the first and second capacitors are connected in series between the gate and source of the drive transistor. A third transistor is then connected across the terminals of the second capacitor, controlled by a third gate control line which is shared between a row of pixels. The second and third gate control lines comprise a single shared control line.

Alternatively, the first and second capacitors can be connected in series between the gate and drain of the drive transistor. A third transistor is then connected between the input and the source of the drive transistor. This third transistor can be controlled by a third gate control line which is shared between a row of pixels. Again, the second and third gate control lines can comprise a single shared control line.

In each case, the third transistor is used to short out the second capacitor so that the first capacitor alone can store the gate-source voltage of the drive transistor.

Each pixel may further comprise a fourth transistor connected between the drive transistor source and a ground potential line. This is used to act as a drain for current from the drive transistor, without illuminating the display element, particularly during the pixel programming sequence. The fourth transistor can also be controlled by a fourth gate control line which is shared between a row of pixels. The ground potential line may be shared between a row of pixels and comprise the fourth gate control line for the fourth transistors of an adjacent row of pixels.

In another arrangement, the capacitor arrangement is connected between the gate and source of the drive transistor, and the source of the drive transistor is connected to a ground line. The drain of the drive transistor is connected to one terminal of the display element, the other terminal of the display element being connected to a power supply line. This provides a circuit with reduced complexity, but the circuit elements are on the anode side of the display element.

Each pixel further may further comprise a second transistor connected between the gate and drain of the drive transistor, a shorting transistor connected across the terminals of the second capacitor, a charging transistor connected between a power supply line and the drain of the drive transistor, and a discharging transistor connected between the gate and drain of the drive transistor.

In some circuits of the invention, the terminal of the display element opposite to the drive transistor may be connected to a switchable voltage line. This may be a common cathode line which is shared between a row of pixels. The ability to change the voltage on this line requires it to be "structured", in particular into separate conductors for separate rows.

In order to avoid the need to provide a structured electrode, and to allow all pixels of the array to share a common display element electrode opposite the drive transistor, each pixel may further comprise a second drive transistor. The second drive transistor may be provided between a power supply line and the first drive transistor, or else between the first drive transistor and the display element. In each case, the second drive transistor provides a way of preventing illumination of the display element during an addressing phase, and without needing to change the voltages on a power supply line or on a common display element terminal.

The display element may comprise an electroluminescent (EL) display element, such as an electrophosphorescent organic electroluminescent display element.

The invention also provides a method of driving an active matrix display device comprising an array of current driven light emitting display pixels, each pixel comprising an display element and an amorphous silicon drive transistor for driving a current through the display element, the method comprising, for each pixel:

driving a current through the drive transistor to ground, and charging a first capacitor to the resulting gate-source voltage;

discharging the first capacitor until the drive transistor turns off, the first capacitor thereby storing a threshold voltage;

charging a second capacitor, in series with the first capacitor between the gate and source or drain of the drive transistor, to a data input voltage; and using the drive transistor to drive a current through the display element using a gate voltage that is derived from the voltages across the first and second capacitors.

This method measures a drive transistor threshold voltage in each addressing sequence. The method is for an amorphous silicon TFT pixel circuit, particularly with an n-type drive TFT, so that a short pixel programming must be achieved to enable large displays to be addressed. This can be achieved in this method via threshold voltage measurement in a pipelined addressing sequence (namely with the address sequence for adjacent rows overlapping in time) or by measuring all threshold voltages at the beginning of the frame in the blanking period.

In the pipelined address sequence, the step of charging a second capacitor is carried out by switching on an address transistor connected between a data line and an input to the pixel. The address transistor for each pixel in a row is switched on simultaneously by a common row address control line, and the address transistors for one row of pixels are turned on substantially immediately after the address transistors for an adjacent row are turned off.

In the blanking period sequence, the first capacitor of each pixel is charged to store a respective threshold voltage of the pixel drive transistor at an initial threshold measurement period of a display frame period, a pixel driving period of the frame period following the threshold measurement period.

The invention will now be described by way of example with reference to the accompanying drawings, in which.

The same reference numerals are used in different figures for the same components, and description of these components will not be repeated.

Figure 3:
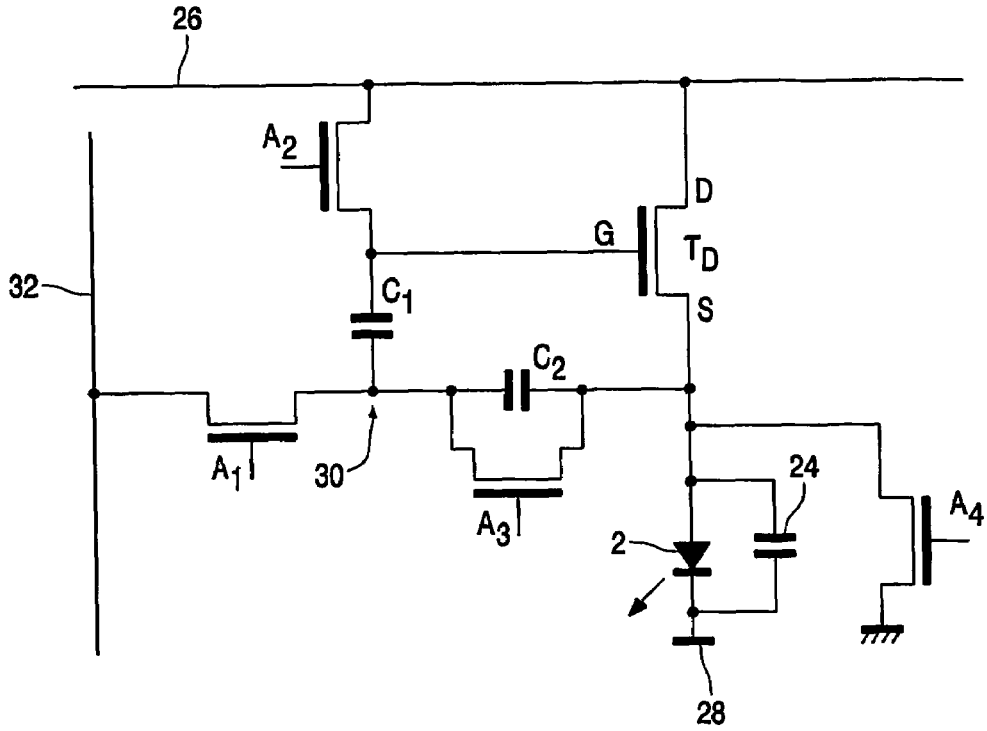
FIG. 3 shows a schematic diagram of a first example of pixel layout for a display device of the invention.

FIG. 3 shows a first pixel arrangement in accordance with the invention. In the preferred embodiments, each pixel has an electroluminescent (EL) display element 2 and an amorphous silicon drive transistor $T_D$ in series between a power supply line 26 and a cathode line 28. The drive transistor $T_D$ is for driving a current through the display element 2.

First and second capacitors $C_1$ and $C_2$ are connected in series between the gate and source of the drive transistor $T_D$. A data input to the pixel is provided to the junction 30 between the first and second capacitors and charges the second capacitor $C_2$ to a pixel data voltage as will be explained below. The first capacitor $C_1$ is for storing a drive transistor threshold voltage on the first capacitor $C_1$.

An input transistor $A_1$ is connected between an input data line 32 and the junction 30 between the first and second capacitors. This first transistor times the application of a data voltage to the pixel, for storage on the second capacitor $C_2$.

A second transistor $A_2$ is connected between the gate and drain of the drive transistor $T_D$. This is used to control the supply of current from the power supply line 26 to the first capacitor $C_1$. Thus, by turning on the second transistor $A_2$, the first capacitor $C_1$ can be charged to the gate-source voltage of the drive transistor $T_D$.

A third transistor $A_3$ is connected across the terminals of the second capacitor $C_2$. This is used to short out the second capacitor so that the first capacitor alone can store the gate-source voltage of the drive transistor $T_D$.

A fourth transistor $A_4$ is connected between the source of the drive transistor $T_D$ and ground. This is used to act as a drain for current from the drive transistor, without illuminating the display element, particularly during the pixel programming sequence.

Figure 1:
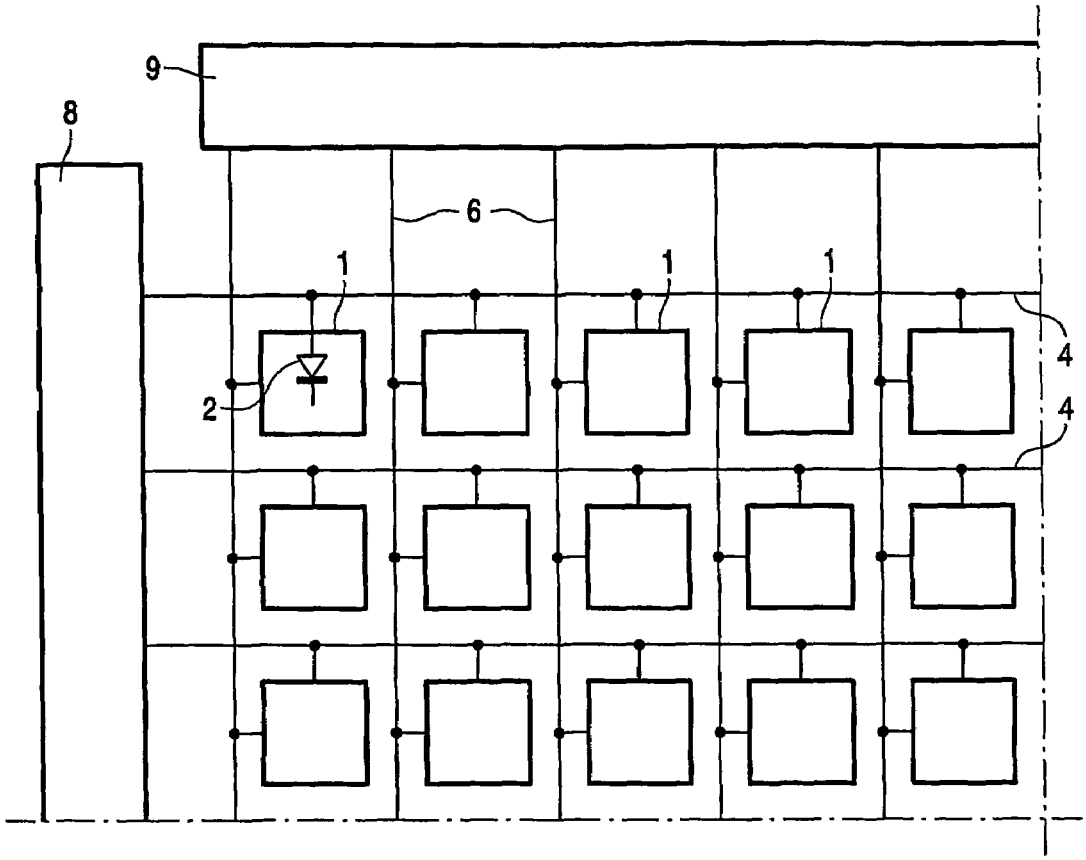
FIG.1 PRIOR ART
FIG. 1 shows a known EL display device.
Figure 2:
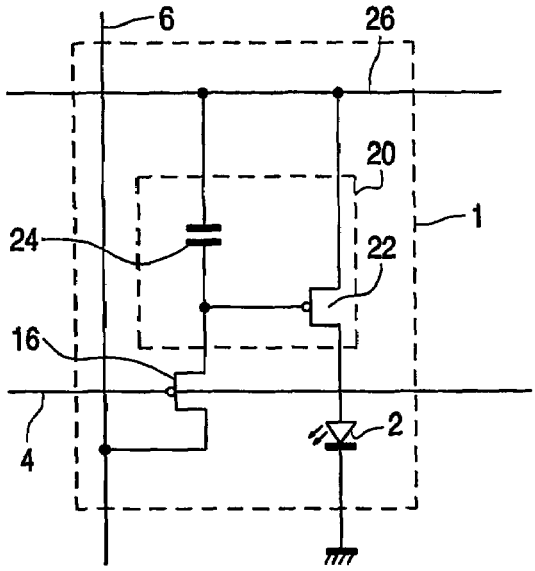
FIG.2 PRIOR ART
FIG. 2 is a schematic diagram of a known pixel circuit for current-addressing the EL display pixel using an input drive voltage.

The capacitor 24 may comprise an additional storage capacitor (as in the circuit of FIG. 2) or it may comprise the self-capacitance of the display element.

The transistors $A_1$ to $A_4$ are controlled by respective row conductors which connect to their gates. As will be explained further below, some of the row conductors may be shared. The addressing of an array of pixels thus involves addressing rows of pixels in turn, and the data line 32 comprises a column conductor, so that a full row of pixels is addressed simultaneously, with rows being addressed in turn, in conventional manner.

The circuit of FIG. 3 can be operated in a number of different ways. The basic operation will first be described, and the way this can be extended to provide pipelined addressing is then explained. Pipelined addressing means there is some timing overlap between the control signals of adjacent rows.

Figure 4:
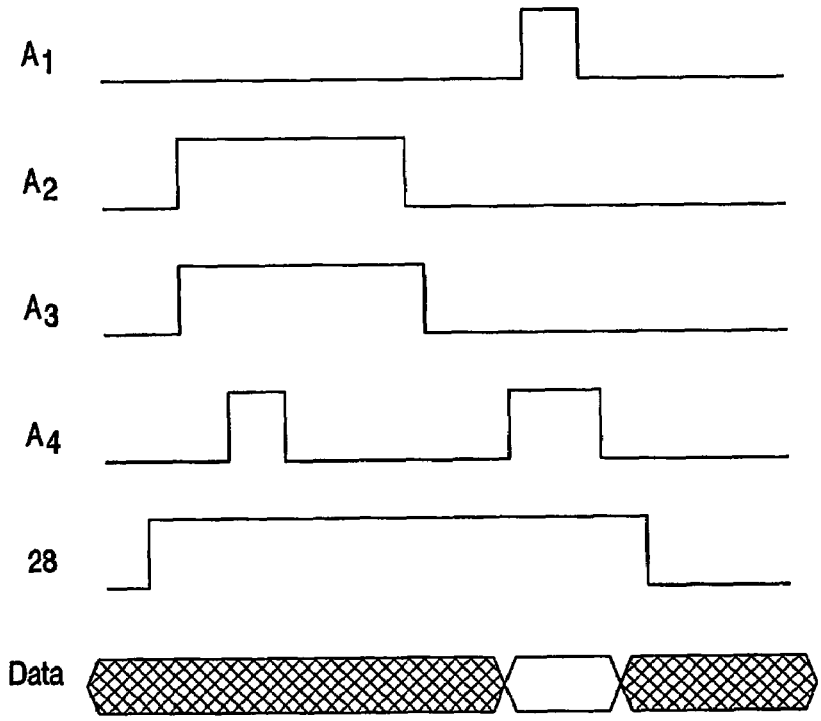
FIG. 4 is a timing diagram for a first method of operation of the pixel layout of FIG. 3.

Only the drive transistor $T_D$ is used in constant current mode. All other TFTs $A_1$ to $A_4$ in the circuit are used as switches that operate on a short duty cycle. Therefore, the threshold voltage drift in these devices is small and does not affect the circuit performance. The timing diagram is shown in FIG. 4. The plots $A_1$ to $A_4$ represent the gate voltages applied to the respective transistors. Plot "28" represents the voltage applied to cathode line 28, and the clear part of the plot "DATA" represents the timing of the data signal on the data line 32. The hatched area represents the time when data is not present on the data line 32. It will become apparent from the description below that data for other rows of pixels can be applied during this time so that data is almost continuously applied to the data line 32, giving a pipelined operation.

The circuit operation is to store the threshold voltage of the drive transistor $T_D$ on $C_1$, and then store the data voltage on $C_2$ so that the gate-source of $T_D$ is the data voltage plus the threshold voltage.

The circuit operation comprises the following steps.

The cathode (line 28) for the pixels in one row of the display is brought to a voltage sufficient to keep the LED reversed bias throughout the addressing sequence. This is the positive pulse in the plot "28" in FIG. 4.

Address lines $A_2$ and $A_3$ go high to turn on the relevant TFTs. This shorts out capacitor $C_2$ and connects one side of capacitor $C_1$ to the power line and the other to the LED anode.

Address line $A_4$ then goes high to turn on its TFT. This brings the anode of the LED to ground and creates a large gate-source voltage on the drive TFT $T_D$. In this way $C_1$ is charged, but not $C_2$ as this remains short circuited.

Address line $A_4$ then goes low to turn off the respective TFT and the drive TFT $T_D$ discharges capacitor $C_1$ until it reaches its threshold voltage. In this way, the threshold voltage of the drive transistor $T_D$ is stored on $C_1$. Again, there is no voltage on the second capacitor $C_2$.

$A_2$ is brought low to isolate the measured threshold voltage on the first capacitor $C_1$, and $A_3$ is brought low so that the second capacitor $C_2$ is no longer short-circuited.

$A_4$ is then brought high again to connect the anode to ground. The data voltage is then applied to the second capacitor $C_2$ whilst the input transistor is turned on by the high pulse on $A_1$.

Finally, $A_4$ goes low followed by the cathode been brought down to ground. The LED anode then floats up to its operating point.

The cathode can alternatively be brought down to ground after $A_2$ and $A_3$ have been brought low and before $A_4$ is taken high.

The addressing sequence can be pipelined so that more than one row of pixels can be programmed at any one time. Thus, the addressing signals on lines $A_2$ to $A_4$ and the row wise cathode line 28 can overlap with the same signals for different rows. Thus, the length of the addressing sequence does not imply long pixel programming times, and the effective line time is only limited by the time required to charge the second capacitor $C_2$ when the address line $A_1$ is high. This time period is the same as for a standard active matrix addressing sequence. The other parts of the addressing mean that the overall frame time will only be lengthened slightly by the set-up required for the first few rows of the display. However this set can easily be done within the frame-blanking period so the time required for the threshold voltage measurement is not a problem.

Figure 5:
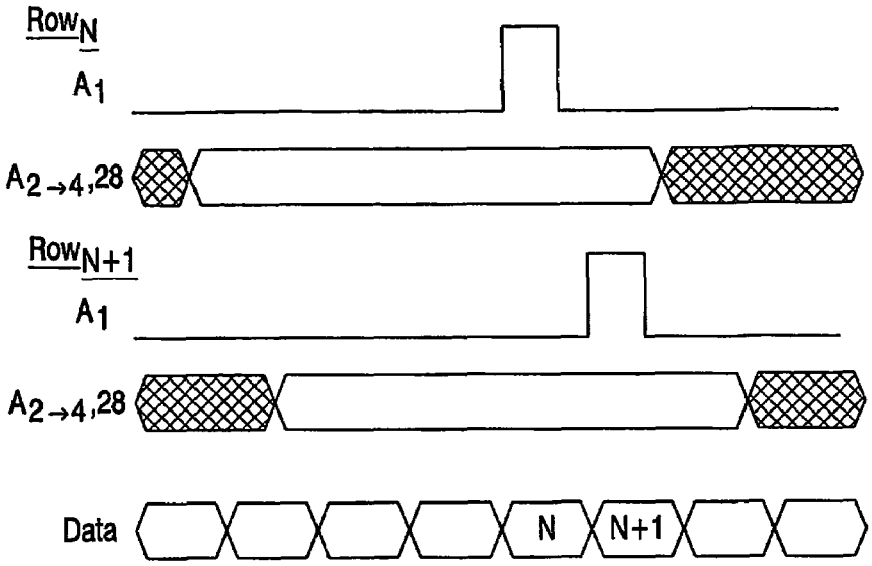
FIG. 5 is a timing diagram for a second method of operation of the pixel layout of FIG. 3.

Pipelined addressing is shown in the timing diagrams of FIG. 5. The control signals for the transistors $A_2$ to $A_4$ have been combined into a single plot, but the operation is as described with reference to FIG. 4. The "Data" plot in FIG. 5 shows that the data line 32 is used almost continuously to provide data to successive rows.

In the method of FIGS. 4 and 5, the threshold measurement operation is combined with the display operation, so that the threshold measurement and display is performed for each row of pixels in turn.

Figure 6:
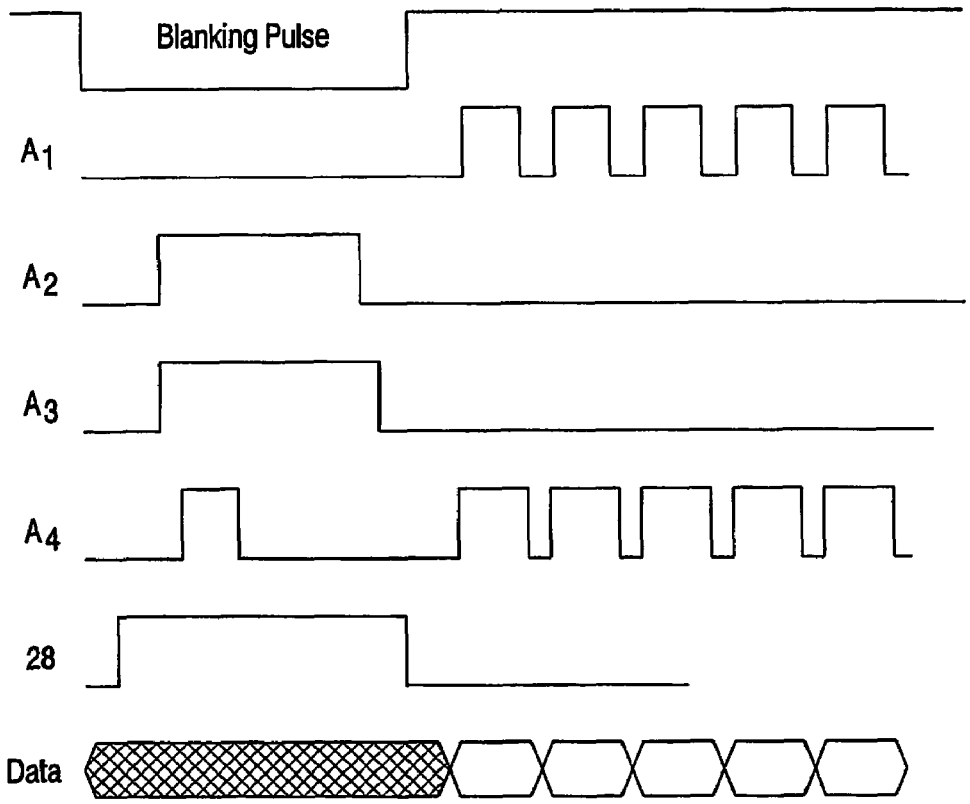
FIG. 6 is a timing diagram for a third method of operation of the pixel layout of FIG. 3.

FIG. 6 shows timing diagrams for a method in which the threshold voltages are measured at the beginning of the frame for all pixels in the display. The plots in FIG. 6 correspond to those in FIG. 4. The advantage of this approach is that a structured cathode (namely different cathode lines 28 for different rows, as required to implement the method of FIGS. 4 and 5) is not required, but the disadvantage is that leakage currents may result in some image non-uniformity. The circuit diagram for this method is still FIG. 3.

As shown in FIG. 6, the signals $A_2$, $A_3$, $A_4$ and the signal for cathode line 28 in FIG. 6 are supplied to all pixels in the display in a blanking period to perform the threshold voltage measurement. Signal $A_4$ is supplied to every pixel simultaneously in the blanking period, so that all the signals $A_2$ to $A_4$ are supplied to all rows at the same time. During this time, no data can be provided to the pixels, hence the shaded portion of the data plot at the base of FIG. 6.

In the subsequent addressing period, data is supplied separately to each row in turn, as is signal $A_1$. The sequence of pulses on $A_1$ in FIG. 6 represent pulses for consecutive rows, and each pulse is timed with the application of data to the data lines 32.

Figure 7:
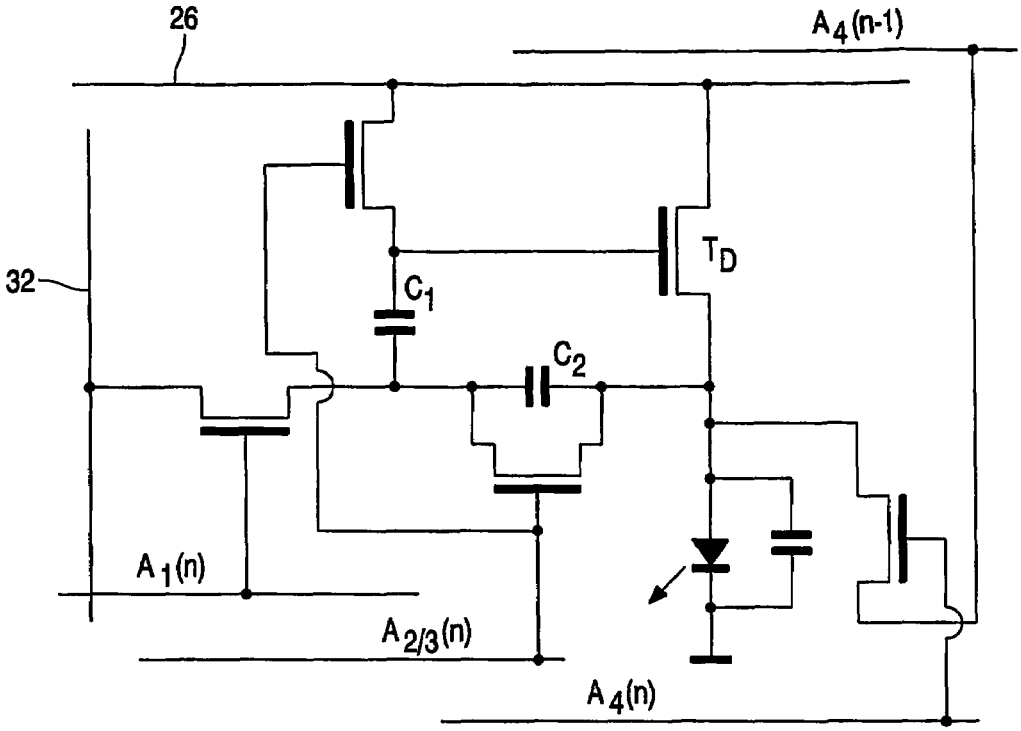
FIG. 7 shows a schematic diagram of a second example of pixel layout for a display device of the invention.

The circuit in FIG. 3 has large number of rows, for the control of the transistors and for the structure cathode lines (if required). FIG. 7 shows a circuit modification which reduces the number of rows required. The timing diagrams show that signals $A_2$ and $A_3$ are very similar. Simulations show that $A_2$ and $A_3$ can in fact be made the same so that only one address line is required. A further reduction can be made by connecting the ground line associated with the transistor $A_4$ in FIG. 3 to the address line $A_4$ in a previous row. The circuit in FIG. 7 shows the address lines for row n and row n−1.

Figure 8:
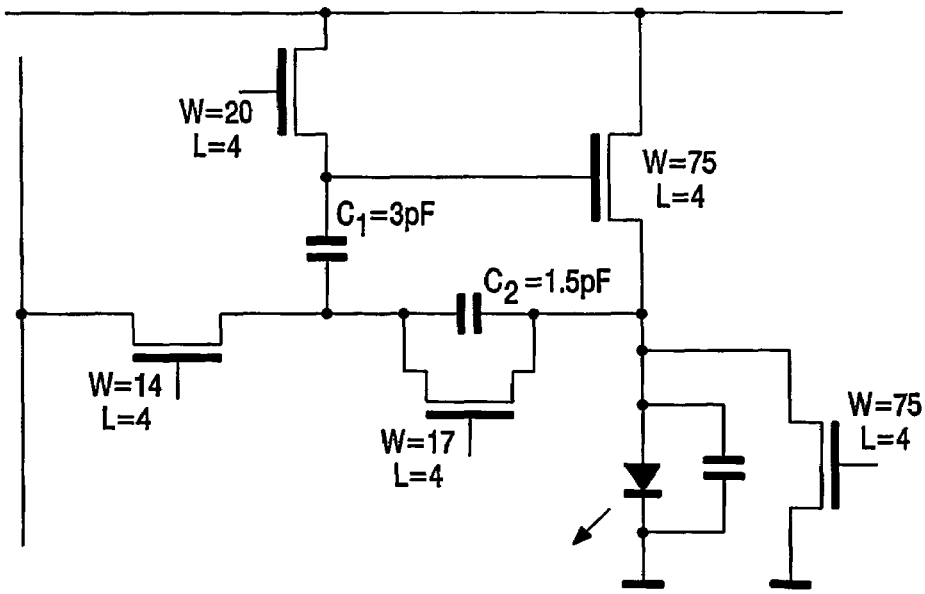
FIG. 8 shows example component values for the circuit of FIG. 3 or 7.

FIG. 8 shows the component values for the circuit of FIG. 3 used in an example simulation. The length (L) and width (W) dimensions for the transistors are given in units of μm. The addressing time was 16 μs (i.e. the time $A_1$ is on). The circuit delivers up to 1.5 μA to the LED with 5V above threshold on the drive TFT. TFT mobility was 0.41 $cm^2/Vs$. Using an LED of efficiency 10 Cd/A (currently available Super-yellow Polymer Efficiency) in a pixel of size 400 μm×133 μm will result in 280 $Cd/m^2$ assuming full aperture in a top-emitting structure.

The simulation shows that a variation of threshold voltage (for the drive transistor) from 4V up to 10V results in only a 10% change in output current. The lifetime of such a display can be calculated to be 60,000 hrs at room temperature and 8000 hrs at 40° C.

Figure 9:
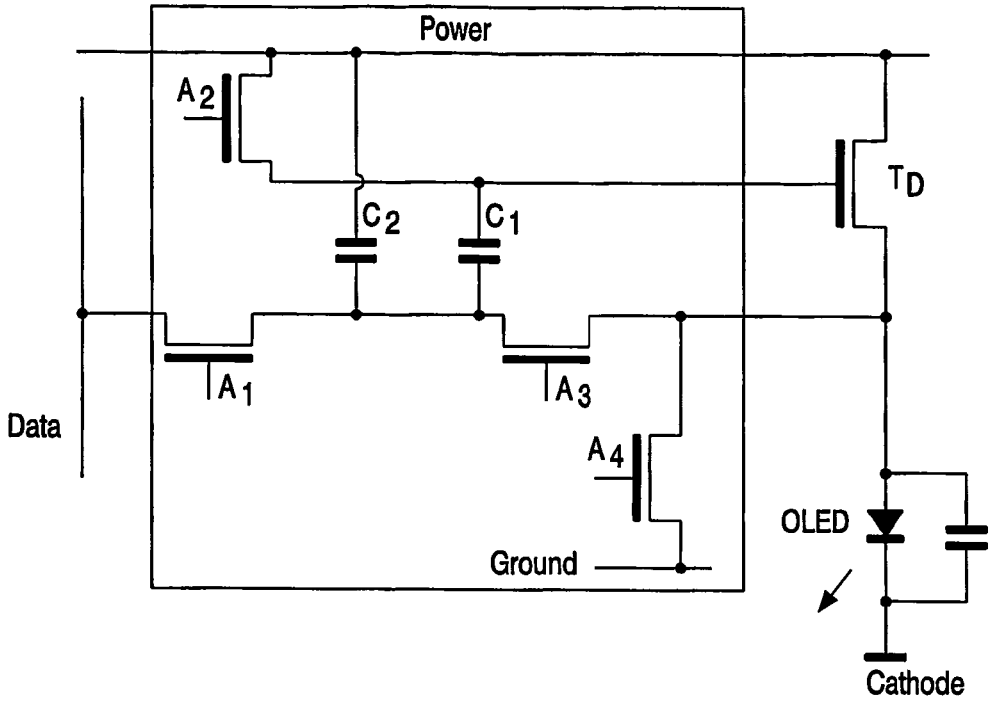
FIG. 9 shows a schematic diagram of a third example of pixel layout with threshold voltage compensation of the invention.

FIG. 9 shows a modification to the circuit of FIG. 3. Although this will not be described in detail in this application, the circuit of FIG. 9 may be of particular use in a pixel circuit in which each pixel has two or more drive transistors which are operated alternately. The circuit of FIG. 9 can be duplicated into a single pixel in a simplified manner, by reducing the component count. This is achieved by allowing some of the TFTs to have dual functions. Where multiple drive transistors are provided, independent control of either the source or gate of the multiple drive TFTs is required, and all TFTs used for controlling the two drive TFTs must operate on a normally off basis i.e. have a low duty cycle, unless these TFTs have some $V_T$ drift correction themselves.

The TFT connected to address line $A_4$ in FIG. 3 will be large, as it needs to pass the current delivered by the drive TFT in the addressing period. Therefore this TFT is an ideal candidate for a dual purpose TFT i.e. one that acts both as a driving TFT and an addressing TFT. Unfortunately the circuit shown in FIG. 3 will not allow this.

In FIG. 9, the same references are used to denote the same components as in the circuit of FIG. 3, and description is not repeated.

In this circuit, the first and second capacitors $C_1$ and $C_2$ are connected in series between the gate and drain of the drive transistor $T_D$. Again, the input to the pixel is provided to the junction between the capacitors. The first capacitor $C_1$ for storing the threshold voltage is connected between the drive transistor gate and the input. The second capacitor $C_2$ for storing the data input voltage is connected directly between the pixel input and the power supply line (to which the transistor drain is connected). The transistor connected to control line $A_3$, is again for providing a charging path for the first capacitor $C_1$ which bypasses the second capacitor $C_2$, so that the capacitor $C_1$ alone can be used to store a threshold gate-source voltage.

Figure 10:
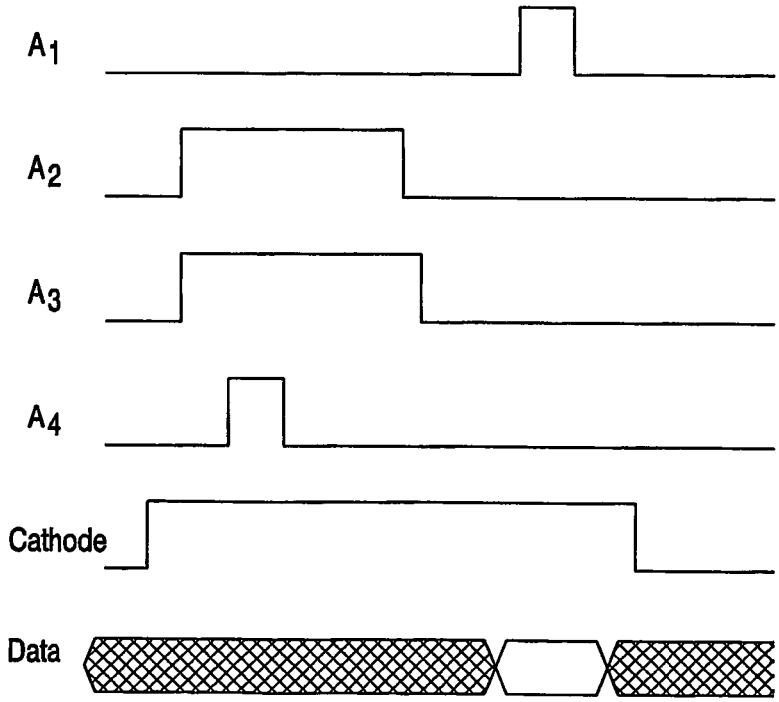
FIG. 10 is a timing diagram for operation of the pixel layout of FIG. 9.

The circuit operation is shown in FIG. 10 and has the following steps:

The cathode for the pixels in one row of the display is brought to a voltage sufficient to keep the LED reversed bias throughout the addressing sequence.

Address lines $A_2$ and $A_3$ go high to turn on the relevant TFTs, this connects the parallel combination of $C_1$ and $C_2$ to the power line.

Address line $A_4$ then goes high to turn on its TFT, this brings the anode of the LED to ground and creates a large gate-source voltage on the drive TFT $T_D$.

Address line $A_4$ then goes low to turn off the TFT and the drive TFT $T_D$ discharges the parallel capacitance $C_1$+$C_2$ until it reaches its threshold voltage.

Then $A_2$ and $A_3$ are brought low to isolate the measured threshold voltage.

$A_1$ is then turned on and the data voltage is stored on capacitance $C_1$.

Finally $A_4$ goes low followed by the cathode being brought down to ground.

Again, pipelined addressing or threshold measurement in the blanking period can be performed with this circuit, as explained above.

A voltage $V_{data}-V_T$ is thus stored on the gate-drain of the drive TFT. Therefore:

$$I = \frac{\beta}{2}(V_{gs} - V_T)^2 = \frac{\beta}{2}(V_{ds} - V_{dg} - V_T)^2 = \frac{\beta}{2}(V_{ds} - V_{data})^2$$

Hence, the threshold voltage dependence is removed. It is noted that the current is now dependent upon the LED anode voltage.

The circuits above have rather a large number of components (due to the independent gate and source of the driving TFTs). A circuit with only one node independent i.e. source or gate can result in a lower component count. In the following, a circuit is described that uses circuitry on the cathode side of the LED and uses independent source voltages to achieve a threshold voltage measurement circuit with recovery. The threshold voltage measurement circuit is described with reference to FIG. 11 and the timing diagram is in FIG. 12.

Figure 11:
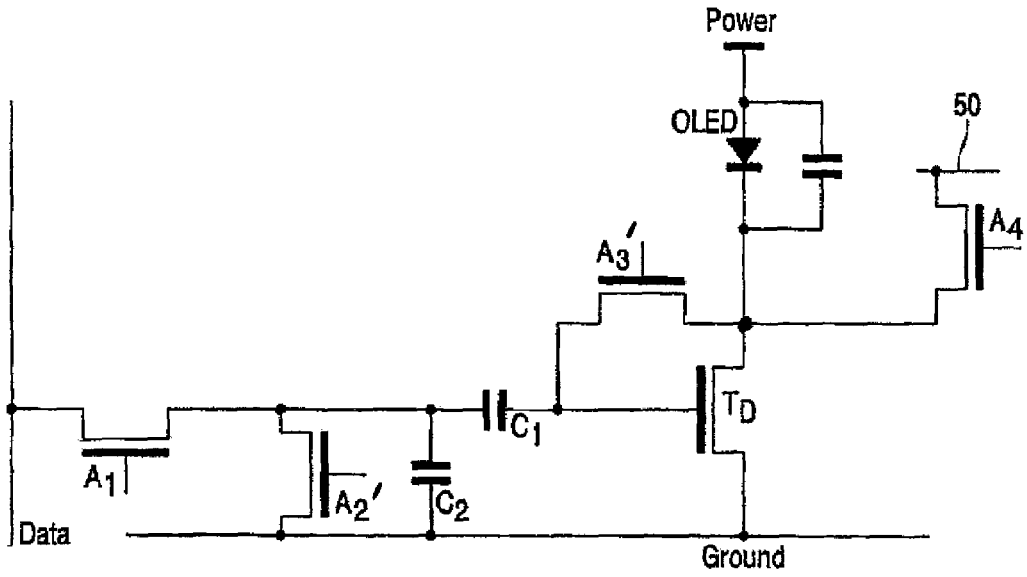
FIG. 11 shows a schematic diagram of a fourth example of pixel layout with threshold voltage compensation of the invention.
Figure 12:
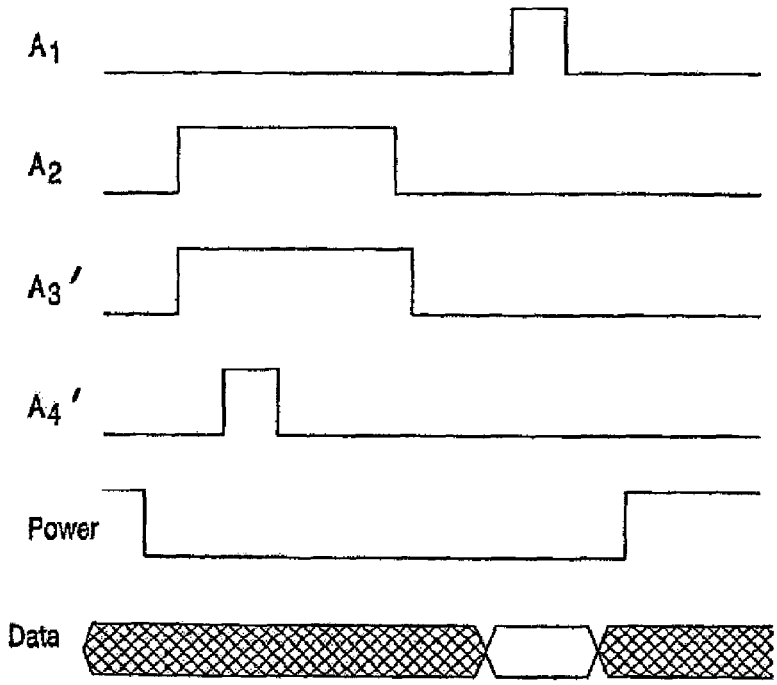
FIG. 12 is a timing diagram for operation of the pixel layout of FIG. 11.

In the circuit of FIG. 11, each pixel has first and second capacitors $C_1$, $C_2$ connected in series between the gate of the drive transistor $T_D$ and a ground line. The source of the drive transistor is connected to the ground line, but when two circuits are combined, the source of each drive transistor is then connected to a respective control line. A data input to the pixel is again provided to the junction between the first and second capacitors.

A shorting transistor is connected across the terminals of the second capacitor $C_2$ and controlled by line $A_2'$. As in the previous circuits, this enables a gate-source voltage to be stored on the capacitor $C_1$ bypassing capacitor $C_2$. A charging transistor associated with control line $A_4$ is connected between a power supply line 50 and the drain of the drive transistor $T_D$. This provides a charging path for the capacitor $C_1$, together with a discharging transistor associated with control line $A_3'$ and connected between the gate and drain of the drive transistor.

The circuit operates by holding $A_2'$ and $A_3'$ high, $A_4$ is then held high momentarily to pull the cathode high and charge the capacitor $C_1$ to a high gate-source voltage. The power line is at ground to reverse bias the LED. $T_D$ then discharges to its threshold voltage (the discharge transistor associated with line $A_1$ being turned on) and it is stored on $C_1$. $A_2'$ and $A_3'$ are then brought low, $A_1$ is brought high and the data is addressed onto $C_2$. The power line is then brought high again to light the LED.

Again, the addressing sequence can be pipelined or the threshold voltages can be measured in a field blanking period.

In the common-cathode circuits of FIGS. 3, 7 and 9 above, a structured cathode is required to allow the cathodes of individual rows to be switched to different voltages during the addressing cycle.

Figure 13:
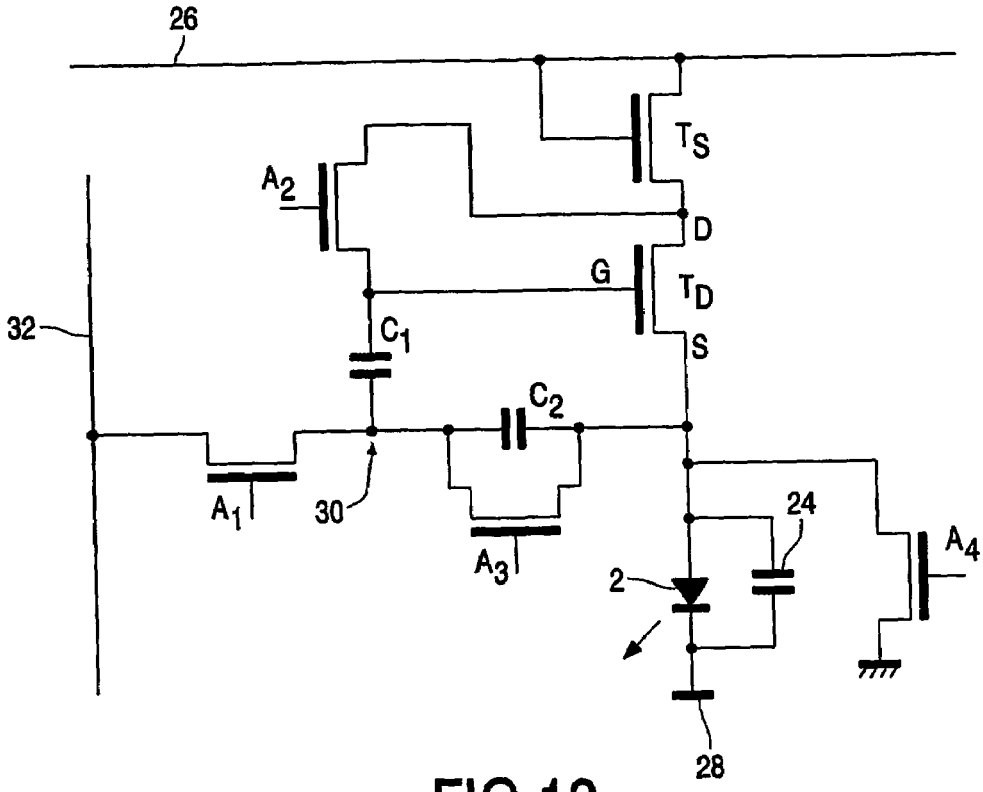
FIG. 13 shows a schematic diagram of a fifth example of pixel layout with threshold voltage compensation of the invention.

FIG. 13 shows a first modification to the circuit of FIG. 3 to avoid the need for a structured cathode. A second drive transistor $T_S$ is provided in series with the first drive transistor $T_D$, and between the power supply line 26 and the first drive transistor $T_D$.

Figure 14:
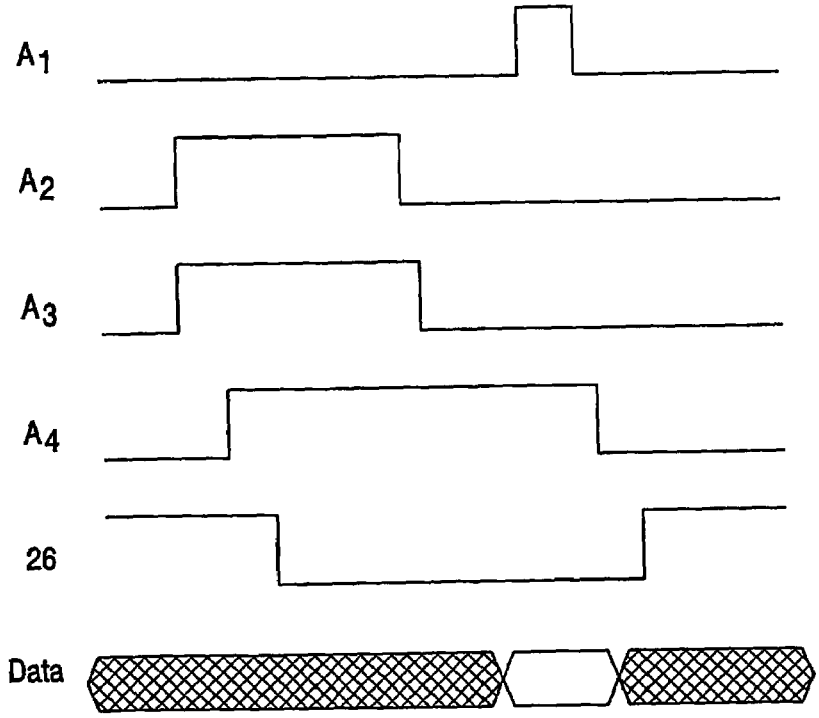
FIG. 14 is a timing diagram for a first method of operation of the pixel layout of FIG. 13.

In this circuit, a switchable voltage is provided on the power supply line 26 (instead of the cathode line 28), and this is used to switch off the second drive transistor $T_S$. The timing of operation is shown in FIG. 14.

As shown, the operation of the circuit is similar to the operation of the circuit of FIG. 4. Instead of the cathode 28 being used to switch off the display element, the power supply line 26 is brought low during the addressing sequence. This turns off the second drive transistor $T_S$, which is diode-connected with its gate and drain connected together.

The power supply line 26 is high for an initial part of the period when the transistors $A_2$-$A_4$ are turned on, as the power line is used during this time to charge the capacitor $C_1$ and the second drive transistor $T_S$ needs to be on during this time. This initial period is sufficiently long for the capacitor $C_1$ to be charged.

When the power supply line is switched low, the second address transistor $T_S$ is turned off. As a result, there is no need to switch off the fourth transistor $A_4$.

Figure 15:
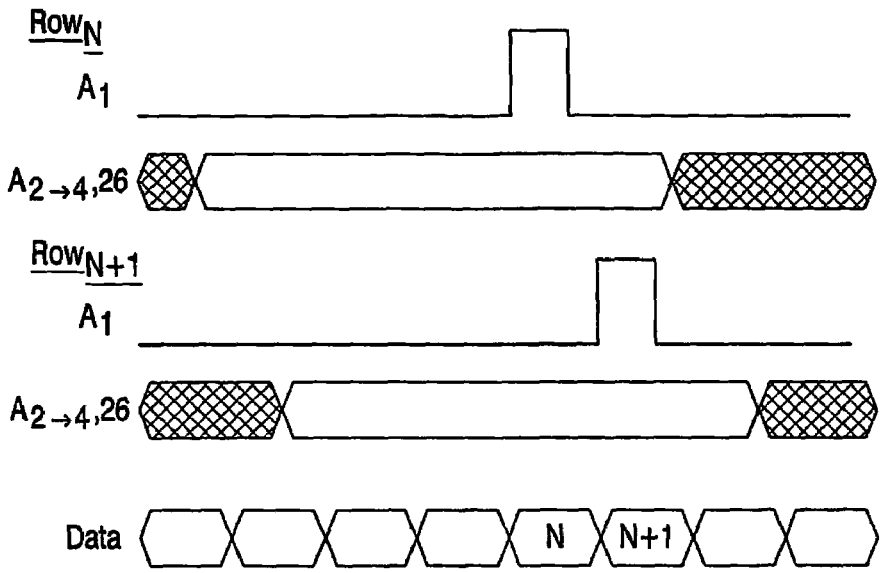
FIG. 15 is a timing diagram for a second method of operation of the pixel layout of FIG. 13.

Again, the addressing may be pipelined as shown in FIG. 15, in a similar manner as explained with reference to FIG. 5.

The addressing scheme of FIG. 15 does not allow any duty cycling of the light output. This is a technique by which the drive transistors are not illuminated all of the time. This allows the threshold voltage drift to be reduced, and also allows improved motion portrayal. To provide duty cycle of the drive transistors, the timing operation of FIG. 15 is modified as shown in FIG. 16.

As explained with reference to FIG. 14, after the capacitor $C_1$ is charged, the voltage on the power supply line 26 is brought low to turn off the current to the display element 2. The first drive transistor $T_D$ will still have a gate-source voltage above the threshold, and this is removed because the transistors $A_2$ and $A_3$ so that the source-drain current of the drive transistor $T_D$ removes the charge on capacitor $C_1$ until the threshold voltage is reached.

Figure 16:
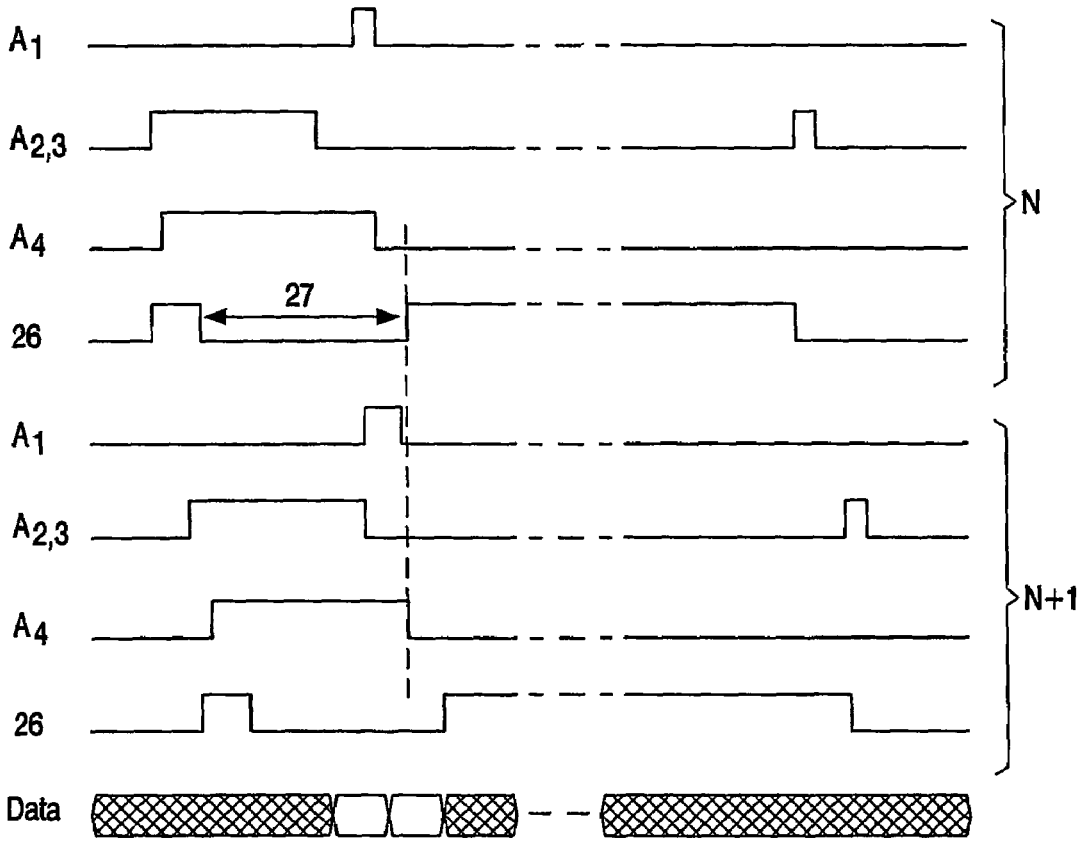
FIG. 16 is a modification to the timing diagram of FIG. 15.

In the scheme of FIG. 16, the power supply line only remains high for a fraction (for example half) of the frame period. As shown in FIG. 16, the power supply line 26 is switched low at some point later in the frame period. To ensure that the drive transistor $T_D$ is then switched off for the remainder of the frame period, a pulse is provided on the control line for transistors $A_2$ and $A_3$ as shown, after the power supply line is switched low.

The fourth transistor $A_4$ is connected to a ground line in the example of FIG. 13. However, it is possible for this transistor to be connected to the power supply line 26 of the previous row (instead of to ground as shown in FIG. 13). The timing of FIG. 16 allows this because when the drive TFTs from the previous row are having their threshold voltages measured, the power supply line is at ground. This period (labeled 27 in FIG. 16) can be used to act as the ground line for the next row of pixels during the time when the fourth transistor is turned on. Thus, the address period for $A_4$ is time to fall within the period when the power supply line for the previous row is low.

The circuit of FIG. 13 adds a second drive transistor between the power supply line 26 and the first drive transistor $T_D$. This second drive transistor will pass the same current as the first drive transistor $T_D$ and no threshold compensation is therefore required. The gate-source voltage will float to the required level for the second drive transistor to source the current demanded by the first drive transistor $T_D$.

An alternative is to add a second drive transistor between the first drive transistor $T_D$ and the display element, again to avoid the need to provide a structured cathode. Again, no specific compensation is required for the second drive transistor.

Figure 17:
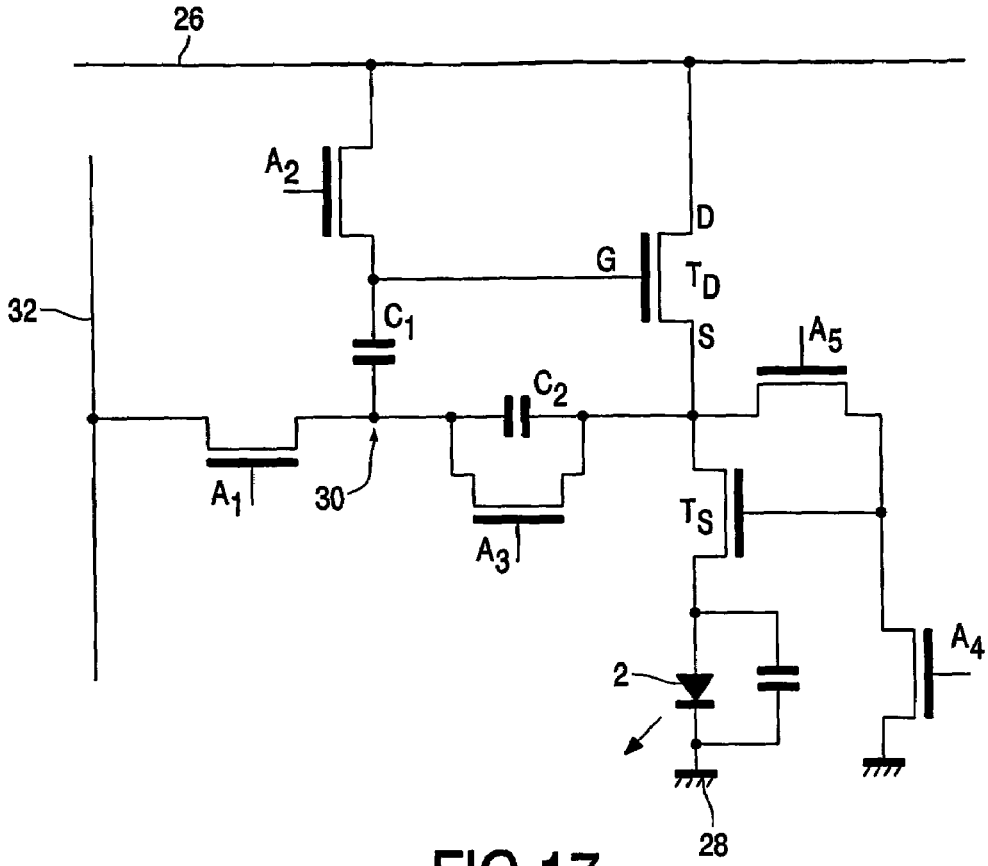
FIG. 17 shows a schematic diagram of a sixth example of pixel layout with threshold voltage compensation of the invention.

An example of such a circuit is shown in FIG. 17. The gate of the second drive transistor $T_S$ is connected to ground through the fourth transistor $A_4$, and a fifth transistor $A_5$ is connected between the gate and drain of the fifth transistor. Otherwise, the circuit is the same as FIG. 3 and operates in the same way.

As will be apparent from the following, this circuit avoids the need to provide a switched voltage on either the common cathode terminal of the display elements or on the power supply line.

Figure 18:
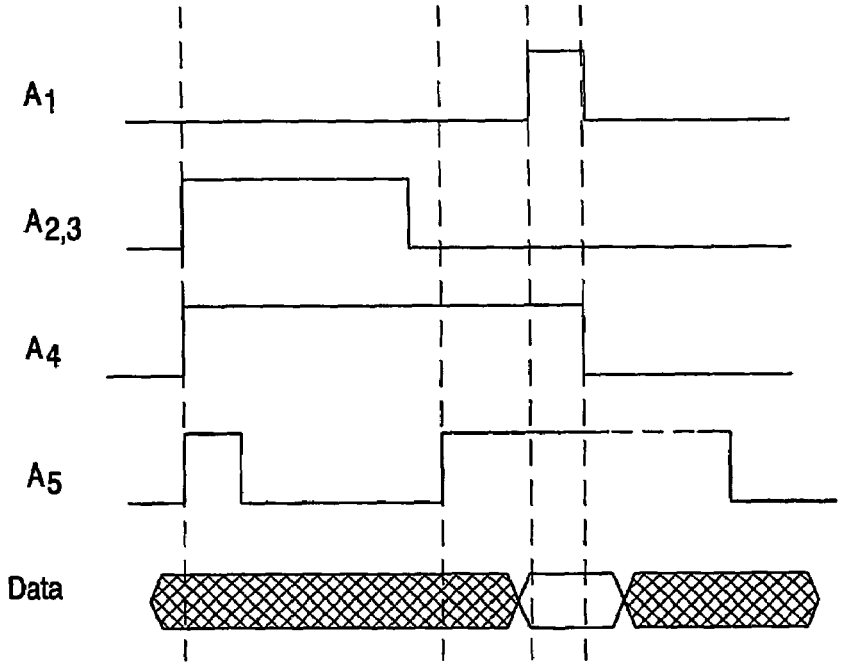
FIG. 18 is a timing diagram for a first method of operation of the pixel layout of FIG. 17.

As shown in FIG. 18, the transistors $A_2$-$A_5$ are all switched on at the beginning of the addressing phase. As for the circuit of FIG. 3, this charges the capacitor $C_1$ to a level which causes the drive transistor $T_D$ to be turned on, and shorts the capacitor $C_2$. The source of the drive transistor $T_D$ is connected to ground through the fourth and fifth transistors $A_4$, $A_5$. During this time, the second drive transistor $T_S$ is turned off, because the gate is coupled to ground through the fourth transistor $A_4$.

The gate for the fifth transistor $A_5$ is then brought low to switch it off. In the same way as for the circuit of FIG. 3, the drive current through the drive transistor (because the source-gate voltage has not changed) discharges the capacitor $C_1$ until the threshold voltage is stored. The voltage on the source of the drive transistor is then the power supply line voltage less the threshold voltage, which is dropped across $C_1$.

The transistors $A_2$ and $A_3$ are then switched off to isolate the capacitors. Before the addressing pulse on $A_1$, the fifth address transistor is again turned on. This pulls the source of the drive transistor $T_D$ (and therefore one terminal of the data storage capacitor $C_2$) to ground through the fourth and fifth transistors, so that the data voltage can be stored on $C_2$ during the addressing phase.

Transistor $A_4$ is turned off at the end of the addressing pulse in order to allow the second drive transistor $T_S$ to turn on (because its gate is no longer held to ground), and the display element is driven.

Transistor A5 is also turned off at the end of addressing. This maintains a short duty cycle for A5 to prevent significant ageing during operation. The gate-source and gate-drain parasitic capacitances of A5 allow the second drive transistor to remain turned on.

Figure 19:
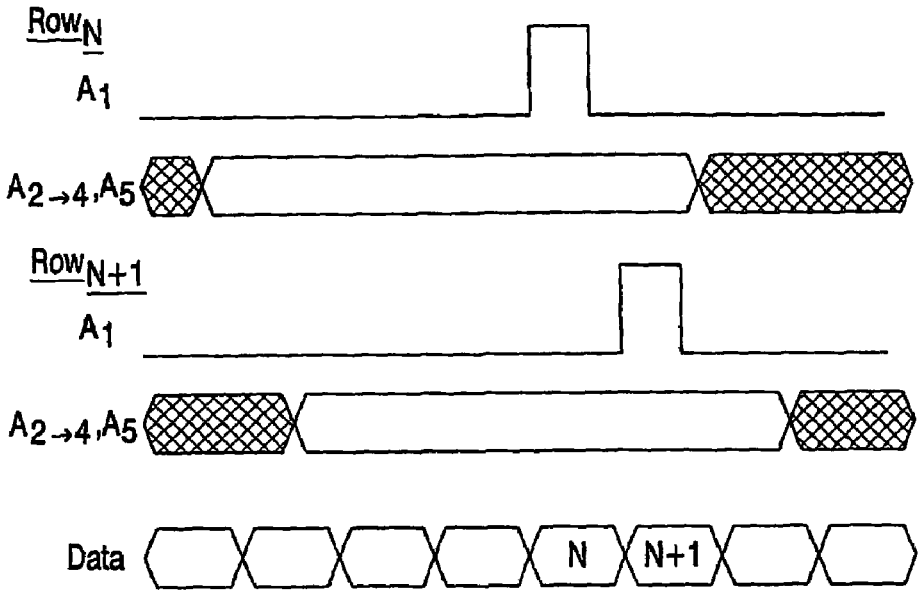
FIG. 19 is a timing diagram for a second method of operation of the pixel layout of FIG. 17.

In the same way as explained above, pipelined addressing may be used, and this is shown in FIG. 19.

Figure 20:
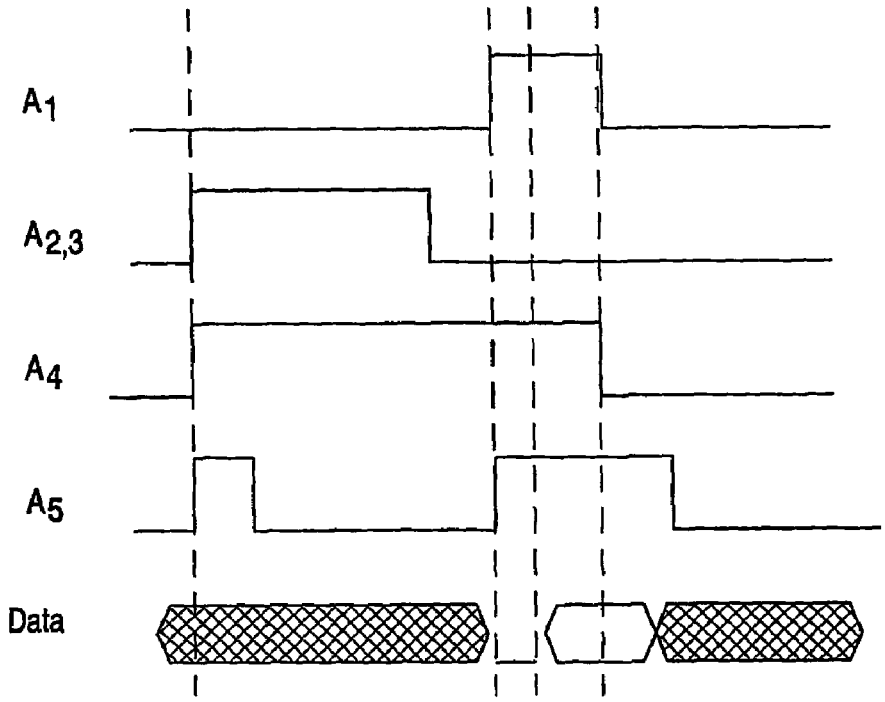
FIG. 20 is a modification to the timing diagram of FIG. 18.

FIG. 20 shows a modification to the timing sequence explained with reference to FIG. 18. In this case, after the transistors $A_2$ and $A_3$ are switched off to isolate the capacitors, the fifth address transistor is turned on at the same time as the address pulse for $A_1$. During an initial part of the addressing pulse, the data line 32 carries a ground voltage (as shown in the bottom plot). Thus, during an initial part of the addressing phase, the junction between the capacitors $C_1$ and $C_2$ is also connected to ground, so that both sides of the capacitor $C_2$ is grounded. Thus, no voltage appears across $C_2$ even though $A_3$ is turned off. This helps to ensure that the threshold voltage of the drive transistor $T_D$ is preserved across $C_1$ after the data signal is loaded onto $C_2$.

There are other variations to the specific circuit layouts which can work in the same way. Essentially, the invention provides a circuit which enables a threshold voltage to be stored on one capacitor and a data signal to be stored on another, with these capacitors in series between the gate and source or drain of the drive transistor. To store the threshold voltage on the first capacitor, the circuit enables the drive transistor to be driven using charge from the first capacitor, until the drive transistor turns off, at which point the first capacitor stores a voltage derived from the threshold gate-source voltage.

The circuits can be used for currently available LED devices. However, the electroluminescent (EL) display element may comprise an electrophosphorescent organic electroluminescent display element. The invention enables the use of a-Si:H for active matrix OLED displays.

The circuits above have been shown implemented with only n-type transistors, and these will all be amorphous silicon devices. Although the fabrication of n-type devices is preferred in amorphous silicon, alternative circuits could of course be implemented with p-type devices.

Various other modifications will be apparent to those skilled in the art.

The invention claimed is:

1. An active matrix device comprising an array of display pixels, each pixel comprising:

a current driven light emitting display element;

an amorphous silicon drive transistor for driving a current through the display element;

first and second capacitors connected in series between gate and source or drain of the drive transistor, a data input to the pixel being provided to a junction between the first and second capacitors thereby to charge the second capacitor to a voltage derived from a pixel data voltage associated with the data input, and a voltage derived from a drive transistor threshold voltage being stored on the first capacitor; and a further transistor connected across terminals of the second capacitor.

2. The device as claimed in claim 1, wherein each pixel further comprises an input first transistor connected between an input data line and the junction between the first and second capacitors.

3. The device as claimed in claim 1, wherein the drain of the drive transistor is connected to a power supply line.

4. The device as claimed in claim 1, wherein each pixel further comprises a second transistor connected between the gate and drain of the drive transistor.

5. The device as claimed in claim 4, wherein the second transistor is controlled by a first gate control line which is shared between a row of pixels.

6. The device as claimed in claim 5, wherein the further transistor is controlled by a further gate control line, and the first and further gate control lines comprise a single shared control line.

7. The device as claimed in claim 1, wherein the first and second capacitors are connected in series between the gate and source of the drive transistor.

8. The device as claimed in claim 1, wherein the further transistor is controlled by a further gate control line which is shared between a row of pixels.

9. The device as claimed in claim 1, wherein the first and second capacitors are connected in series between the gate and drain of the drive transistor.

10. The device as claimed in claim 1, wherein each pixel further comprises a switching transistor connected between the drive transistor source and a ground potential line.

11. The device as claimed in claim 10, wherein the switching transistor is controlled by a switching gate control line which is shared between a row of pixels.

12. The device as claimed in claim 11, wherein the ground potential line is shared between a row of pixels and comprises the switching gate control line for the switching transistors of an adjacent row of pixels.

13. device as claimed in claim 1, wherein a capacitor arrangement including the first and second capacitors is connected between the gate and source of the drive transistor, and the source of the drive transistor is connected to a ground line.

14. The device as claimed in claim 13, wherein the drain of the drive transistor is connected to one terminal of the display element, the other terminal of the display element being connected to a power supply line.

15. The device as claimed in claim 13, wherein each pixel further comprises a further transistor connected between the gate and drain of the drive transistor.

16. The device as claimed in claim 15, wherein the further transistor is controlled by a gate control line which is shared between a row of pixels.

17. The device as claimed in claim 1, wherein each pixel further comprises a second drive transistor.

18. The device as claimed in claim 17, wherein the second drive transistor is provided between a power supply line and the first drive transistor.

19. The device as claimed in claim 18, wherein the gate and drain of the second drive transistor are connected together.

20. The device as claimed in claim 17, wherein the second drive transistor is provided between the first drive transistor and the display element.

21. The device as claimed in claim 20, wherein another transistor is connected between the gate and drain of the second drive transistor.

22. The device as claimed in claim 20, wherein each pixel further comprises another transistor connected between the gate of the second drive transistor and a ground potential line.

23. The device as claimed in claim 1, wherein the drive transistor comprises an n-type transistor.

24. The device as claimed in claim 1, wherein the display element comprises an electroluminescent display element.

25. The device as claimed in claim 24, wherein the electroluminescent display element comprises an electrophosphorescent organic electroluminescent display element.

26. An active matrix device comprising an array of display pixels, each pixel comprising:

a current driven light emitting display element;

an amorphous silicon drive transistor for driving a current through the display element;

first and second capacitors connected in series between gate and source or drain of the drive transistor, a data input to the pixel being provided to a junction between the first and second capacitors thereby to charge the second capacitor to a voltage derived from a pixel data voltage associated with the data input, and a voltage derived from a drive transistor threshold voltage being stored on the first capacitor; and a further transistor connected between the junction between the first and second capacitors, and the source of the drive transistor.

27. The device as claimed in claim 26, wherein the further transistor is controlled by a further gate control line which is shared between a row of pixels.

28. An active matrix device comprising an array of display pixels, each pixel comprising:

a current driven light emitting display element;

an amorphous silicon drive transistor for driving a current through the display element;

first and second capacitors connected in series between gate and source or drain of the drive transistor, wherein the source of the drive transistor is connected to a round line, a data input to the pixel being provided to a junction between the first and second capacitors thereby to charge the second capacitor to a voltage derived from a pixel data voltage associated with the data input, and a voltage derived from a drive transistor threshold voltage being stored on the first capacitor; and a shorting transistor connected across terminals of the second capacitor.

29. An active matrix device comprising an array of display pixels, each pixel comprising:

a current driven light emitting display element;

an amorphous silicon drive transistor for driving a current through the display element;

first and second capacitors connected in series between gate and source or drain of the drive transistor, a data input to the pixel being provided to a junction between the first and second capacitors thereby to charge the second capacitor to a voltage derived from a pixel data voltage associated with the data input, and a voltage derived from a drive transistor threshold voltage being stored on the first capacitor; and a charging transistor connected between a power supply line and the drain of the drive transistor.

30. A method of driving an active matrix display device comprising an array of current driven light emitting display pixels, each pixel comprising an display element and an amorphous silicon drive transistor for driving a current through the display element, the method comprising, for each pixel:

driving a current through the drive transistor ground, and charging a first capacitor to the resulting gate-source voltage;

discharging the first capacitor until the drive transistor turns off, the first capacitor thereby storing a threshold voltage;

charging a second capacitor, in series with the first capacitor between the gate and source or drain of the drive transistor, to a data input voltage; and using the drive transistor to drive a current through the display element using a gate voltage that is derived tram the voltages, across the first and second capacitors.

31. The method as claimed in claim 30, wherein the step of charging a second capacitor is carried out by switching on an address transistor connected between a data line, and an input to the pixel.

32. The method as claimed in claim 31, wherein the address transistor for each pixel in a row is switched on simultaneously by a common row address control line.

33. The method as claimed in claim 32, wherein the address transistors for one row of pixels are turned on substantially immediately after the address transistors for an adjacent row are turned off.

34. The method as claimed in claim 30, wherein, the first capacitor of each pixel is charged to store a respective threshold voltage of the pixel drive transistor at an initial threshold measurement period of a display frame period, a pixel driving period of the frame period following the threshold measurement period.

* * * * *